US007100791B2

(12) United States Patent
Berger

(10) Patent No.: US 7,100,791 B2
(45) Date of Patent: Sep. 5, 2006

(54) HINGED LID TRASH CAN FOR CURBSIDE REFUSE PICKUP

(75) Inventor: John R. Berger, Cincinnati, OH (US)

(73) Assignee: Buckhorn, Inc., Milford, OH (US)

( * ) Notice: Subject to any disclaimer, the term of this patent is extended or adjusted under 35 U.S.C. 154(b) by 81 days.

(21) Appl. No.: 10/436,985

(22) Filed: May 14, 2003

(65) Prior Publication Data

US 2003/0213808 A1 Nov. 20, 2003

(51) Int. Cl.
*B65D 43/16* (2006.01)
*B65D 43/03* (2006.01)

(52) U.S. Cl. ..... 220/831; 220/380; 220/908; 220/770

(58) Field of Classification Search ..... 220/832, 220/908, 380, 770, 831, 834; 206/505
See application file for complete search history.

(56) References Cited

U.S. PATENT DOCUMENTS 4,325,492 A * 4/1982 Kunze ..... 220/831
4,372,007 A * 2/1983 Lee ..... 16/260
4,749,101 A * 6/1988 Durkan, Jr. ..... 220/840
4,836,394 A * 6/1989 Glomski ..... 220/811
5,048,715 A * 9/1991 Wolff ..... 220/832
5,071,024 A * 12/1991 Delmerico et al. ..... 220/832
5,088,750 A * 2/1992 Beese et al. ..... 280/47.26
5,141,124 A * 8/1992 Smith et al. ..... 220/831
5,150,806 A * 9/1992 Glomski ..... 220/815
5,167,351 A * 12/1992 Prout et al. ..... 220/840
5,213,229 A * 5/1993 Taniyama ..... 220/4.23
5,217,136 A * 6/1993 Sanden, Jr. ..... 220/836
5,323,923 A * 6/1994 Schauer ..... 220/831
5,529,205 A * 6/1996 Corney et al. ..... 220/832
5,582,322 A * 12/1996 Prout et al. ..... 220/771
5,975,346 A * 11/1999 Imperato et al. ..... 220/831
6,243,884 B1 * 6/2001 Simonson ..... 4/236
6,758,366 B1 * 7/2004 Bourgund et al. ..... 220/836

* cited by examiner

*Primary Examiner*—Nathan J. Newhouse
*Assistant Examiner*—James Smalley
(74) *Attorney, Agent, or Firm*—Mattingly, Stanger, Malur & Brundidge, PC

(57) ABSTRACT

A trash container with a lid is emptied by a mechanical lifting device. A latch bar is provided that is engaged by the lift when the container is inverted. The latch bar is mounted in openings on both sides of a wide recess on the front wall of the container. The outer ends of the latch bar extend through the openings into the inside of the container and are accommodated with a clearance portion of a lower stacked container when the containers are stacked together for shipment. The lid is initially assembled in an open position with the lid hanging down vertically. After closing the lid for the first time by rotation of the lid through 270°, a hinge stop prevents the lid from being rotated back to the original position. The hinge stop supports the lid in an open position that is rotated about 110° from the closed position.

5 Claims, 12 Drawing Sheets

HINGED LID TRASH CAN FOR CURBSIDE REFUSE PICKUP

BACKGROUND OF THE INVENTION

The invention relates to a trash can or container with a hinged lid of the type used for curbside refuse pickup.

Large trash can receptacles with hinged lids are used for curbside pickup by refuse trucks. The cans are typically large enough to hold many pounds of trash and are equipped with wheels to roll from a residence to a curbside location for pickup. An operator of the refuse truck guides an articulated, mechanical arm to lift the container from a reinforced flange and a latch bar provided on the front wall of the can. Then, the can is inverted to allow the lid to open and the contents to fall by force of gravity out of the inverted can into the refuse truck bin. The reverse operation leaves the can at its curbside location after it has been dumped.

SUMMARY OF THE INVENTION

There has been an increase in demand for providing trash cans or containers having hinged lids of a size having sufficient capacity to store a large amount of trash that, by weight, is required to be emptied into a refuse truck by use of a mechanical arm. Such trash cans have a hinged lid that rotates from a substantially horizontal position in which the lid is in a closed position through about 270° to a position in which the lid hangs substantially vertical in a position in which the trash can is fully open.

When such trash cans are manufactured, there are two main considerations with respect to distribution of the cans to a refuse removal company or retail outlet, and then to the end user. First, the entity which provides the trash cans to the end user receives the shipments directly from a manufacturer in nested stacks. Since the trash cans already have large overall dimensions, the stacked and nested cans shipped from the manufacturer should be as compact as practical. Secondly, the end user expects to receive a trash can that is fully assembled, which usually requires that the distributing retail entity or waste refusal company supplying the end user must perform the task of completing assembly of the can for the end user.

To complete assembly of a trash can that is received from the manufacturer for the end user, typically a latch bar is required to be inserted in the front of the can in a recess where the mechanical arm engages the bar during emptying of the trash can into a refuse truck.

Accordingly, the present invention is directed to labor savings in that the entity which receives the trash cans from a manufacturer is not required to install the latch bar after the shipment has been received by the distributor or retail outlet. This requires that the latch bar be installed at the time of manufacture. In order to stack the trash cans with the latch bar installed, according to the present invention, a wide recessed area or wall portion on the front wall of the can is provided that is wide enough and recessed enough such that the cans can be stacked in a nested stack with the latch bars fixed in place.

It is another object of the invention to enable a manufacturer to stack and nest a plurality of trash cans in a nested stack with the hinged lids open to a position that is almost vertical and parallel to the back wall of the trash can. In this position, the trash can lids are layered or shingled on one another to maintain a nested stack having a minimum size footprint. However, it also preferable for the end user, when using the can, to have a hinged trash can lid that only swings open approximately 110° from the fully closed position which is substantially horizontal so that the lid does not swing all the way back into its original position. By keeping the open position of the lid at approximately 110° from the closed position, which is approximately 20° more than straight upright, the lid stays open by itself. Further, the user can close the lid without reaching to the other side of the can, which is typically necessary for rotating closed the lid (270°) from the original open position. That is, a user is able to keep the lid open in a convenient use position (110° open position) and then rotate the lid about its hinge axis toward the user to close the lid.

Accordingly, it is a further object of the invention to mount a hinged lid to a trash can that is assembled in an an initial open position approximately 270° from the closed position after manufacture of the trash can and before delivery and use by the end user. Then, after subsequent delivery of the trash can to the end user, the user can rotate the lid of the trash can for the first time to a position fully closing the container and then reopen it. When the lid is reopened, a hinge stop or rotational stop will prevent the lid from being opened (rotated about its hinge axis) more than approximately 110° from the fully closed position.

It is a still further object of the present invention to provide a dual seal structure about the periphery of the lid that abuts the periphery of the trash can. Preferably, such a seal extends about the periphery of the trash can for preventing water from entering the trash can and for keeping odors from escaping the trash can.

DETAILED DESCRIPTION OF THE PREFERRED EMBODIMENTS

Figure 1:
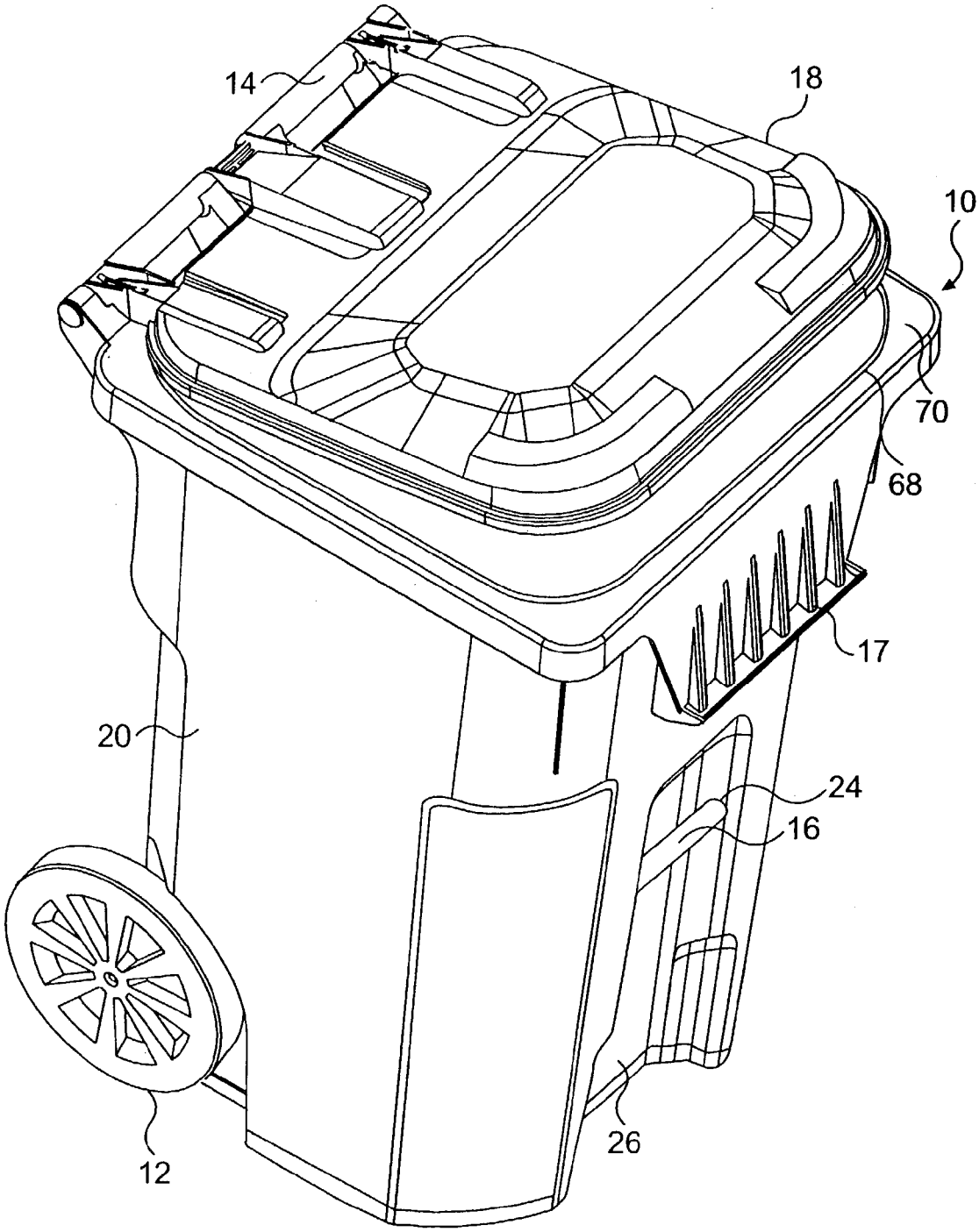
FIG. 1 is a perspective view of a hinged lid trash can adapted for curbside refuse removal according to the present invention.

As shown in FIG. 1, a trash can or container 10 of the present invention is of the type used for curbside collection typically emptied into a refuse truck by use of a mechanical assistance device. The trash can has two wheels 12 and a handle 14 that enables the user to maneuver the trash can to a curbside location or directly to a refuse truck whereupon it is emptied by a mechanical lifting device on the truck. On an upper portion of the front wall of the can is a lifting flange 17 that has a pocket underneath it that is engaged by the lifting device. The device lifts the trash can to dump the contents of the can into the body of the trash truck. To ensure that the can does not become disengaged from the lifting device when the can is inverted, the lift device also engages a latch bar 16 on the front wall of the trash can when the can is inverted. When the can is inverted by the lift device, the lid 18 on the can swings open thereby allowing the contents of the can to be emptied by gravity.

Figure 3:
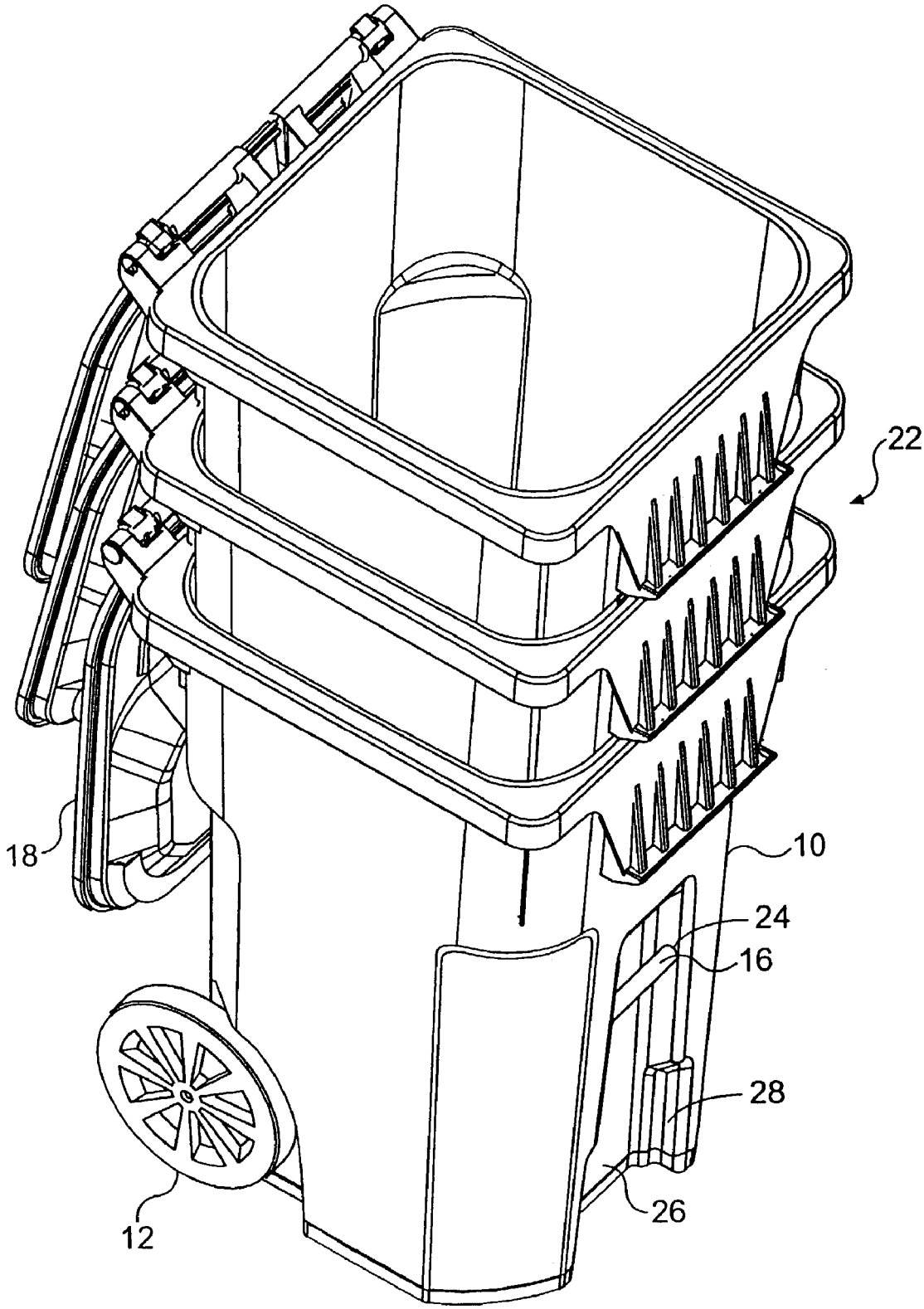
FIG. 3 is a perspective view of a nested stack of a plurality of trash cans of the type shown in FIG. 1.
Figure 4:
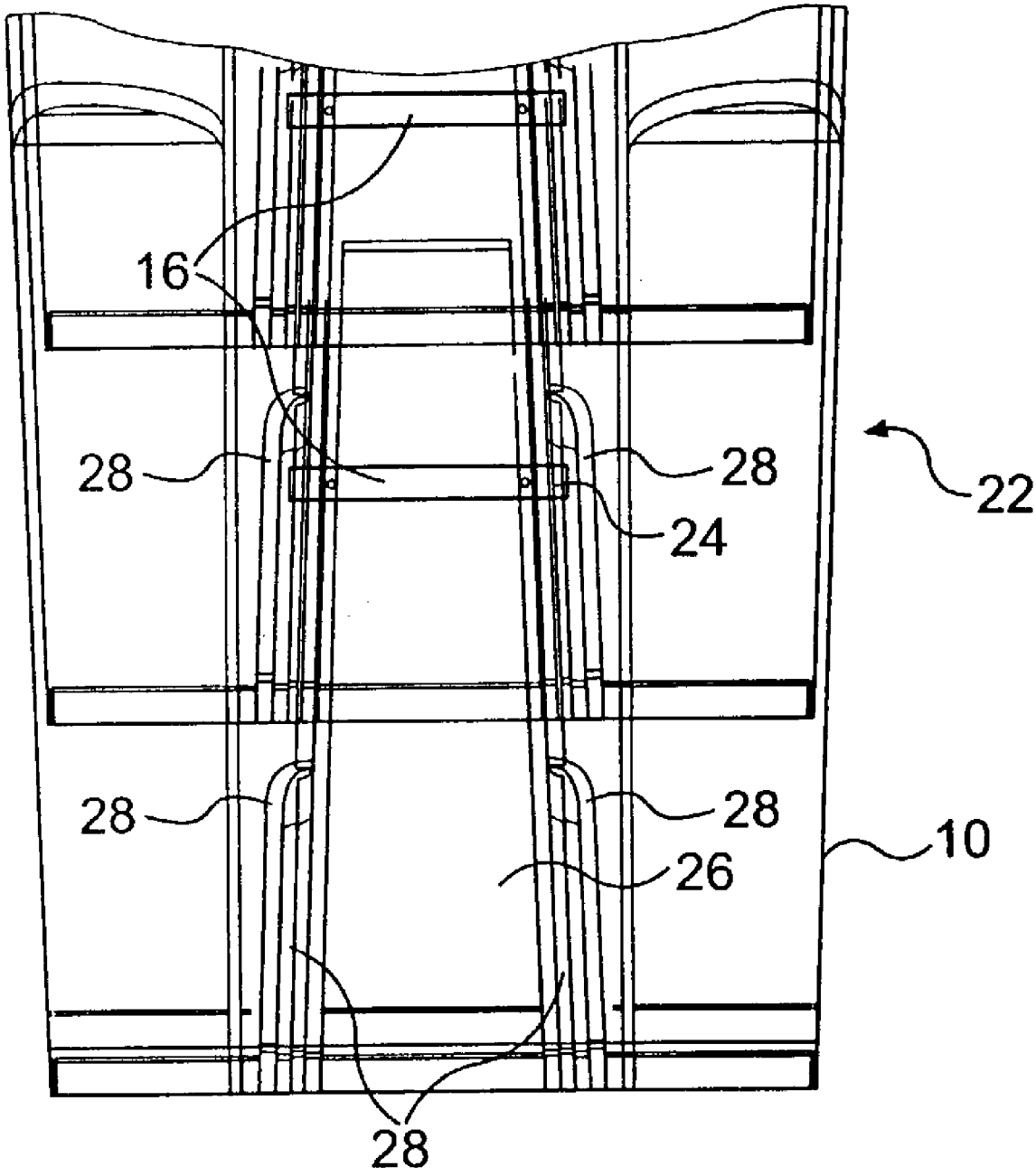
FIG. 4 is a partial front view of a bottom portion of the stack of cans shown in FIG. 2.
Figure 7:
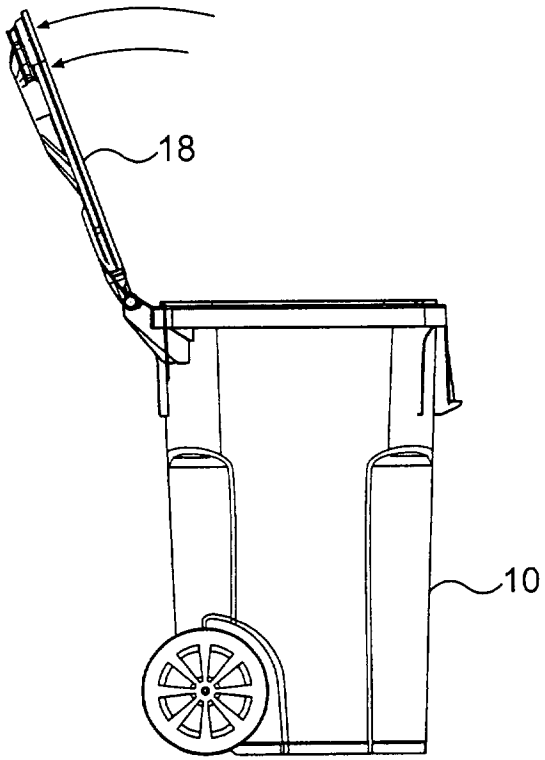
FIG. 7 is a side view of the trash can of FIG. 5 showing the opening of the lid to an open position displaced approximately 110° from the fully closed position.

As best shown in FIGS. 1, 3 and 4, the latch bar 16 is mounted in openings 24 on both sides of a wide recess 26 on the front wall of the can that opens from the bottom of the can. The outer ends of the latch bar extend through the openings 24 into the inside of the can as shown in FIG. 4. That is, the width of the recess is narrower than the length of the latch bar 16. When the cans are stacked in a nested stack, as shown in FIG. 4, it is therefore necessary to provide a clearance portion, such as grooves or cutout portions 28 in the lower part of the side portions of the recessed area 26 of each can to accommodate the outer ends of the latch bar of a lower can in the nested stack. Further, the recessed area and clearance portion are of a depth that accommodates the latch bar 16 when the cans are stacked together. As a result, multiple cans, with the latch bar 16 installed, can be stacked in a nested stack.

Figure 2:
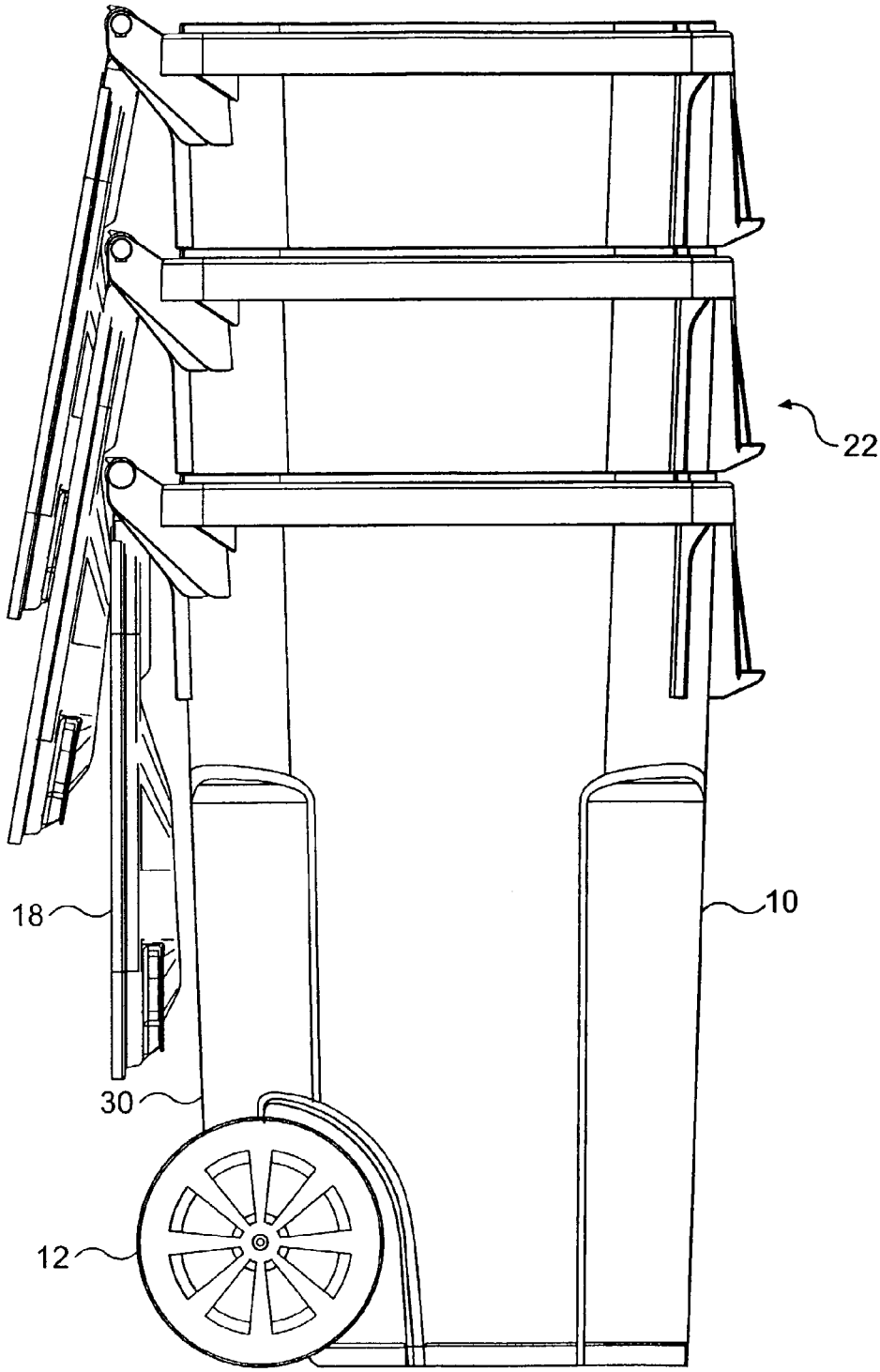
FIG. 2 is a side view of a nested stack of a plurality of trash cans of the type shown in FIG. 1.

The end users for such trash cans are typically residential or small business customers. With reference to FIGS. 2 and 3, the trash can of the present invention is able to be manufactured, for example, by molding the receptacle or body portion 20 of the trash can and the lid 18 separately and then attaching the lid to the receptacle. Further, the latch bar is able to be added in the manufacturing process, but the wheels are installed as part of the assembly of the trash can by the end user or the distributor who delivers the trash can to the end user.

Once a plurality of the trash cans are assembled to be shipped to a distribution center, retail outlet or directly to end users, they are stacked in a nested stack 22 of trash cans, as shown in FIGS. 2 and 3. As shown, the stack has a bottom can with the wheels attached for convenience in moving the stack. In a nested stack, a minimum size footprint or bottom support surface is desired to enable the shipping of a large quantity of trash cans from one location to another, such as from a manufacturer to a distribution center, refuse removal company, retail outlet, etc. At the destination site, it is preferable that the trash cans be ready for immediate delivery to an end user with a minimal need for additional assembly after delivery. In this regard, the lids are attached to the cans, and the latch bars are assembled on the cans, but the wheels are attached after delivery to the end user or distributor.

In a nested stack 22 of trash cans, as shown in FIG. 2, the lid 18 of the bottom most trash can 10 hangs vertically or substantially parallel with a rear wall 30 of the trash can. The lid of the next trash can in the stack is not able to quite hang down vertically, as shown in FIG. 2, but rather engages the lid of the lower most can. This layering or shingling of the trash can lids 18 is repeated for each next upper can of the stack, as shown.

In FIG. 1, the lid is shown in a position which is almost a fully closed position. To reach the fully closed position (FIG. 13) from the initial assembled position shown in FIG. 2, the lid must be rotated approximately 270° about an axis on which the lid is hinged. By maintaining the lids of the cans in the initial assembled position during shipment of the containers, the containers can be stacked in a nested stack as shown in FIGS. 2 and 3 without excessive lid flair among the lids of the trash cans in the nested stack.

Figure 6:
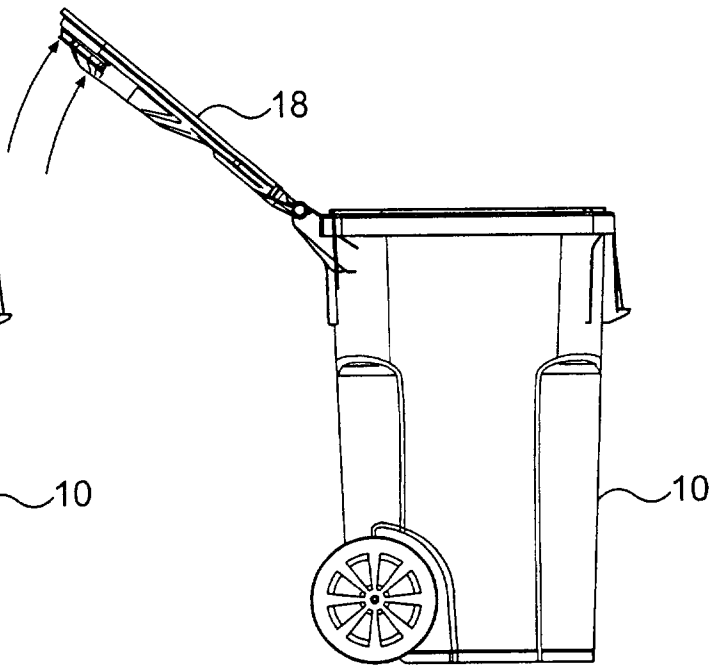
FIG. 6 is a side view of the trash can of FIG. 5 shown with the lid being rotated from the initial position to a position between a horizontal and a vertical position.
Figure 5:
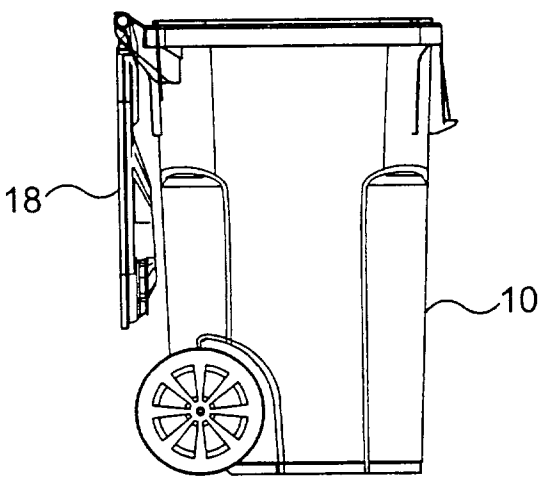
FIG. 5 is a side view of the trash can shown in FIG. 1 with the lid rotated to an initial stacking position parallel to the back side of the can.
Figure 10:
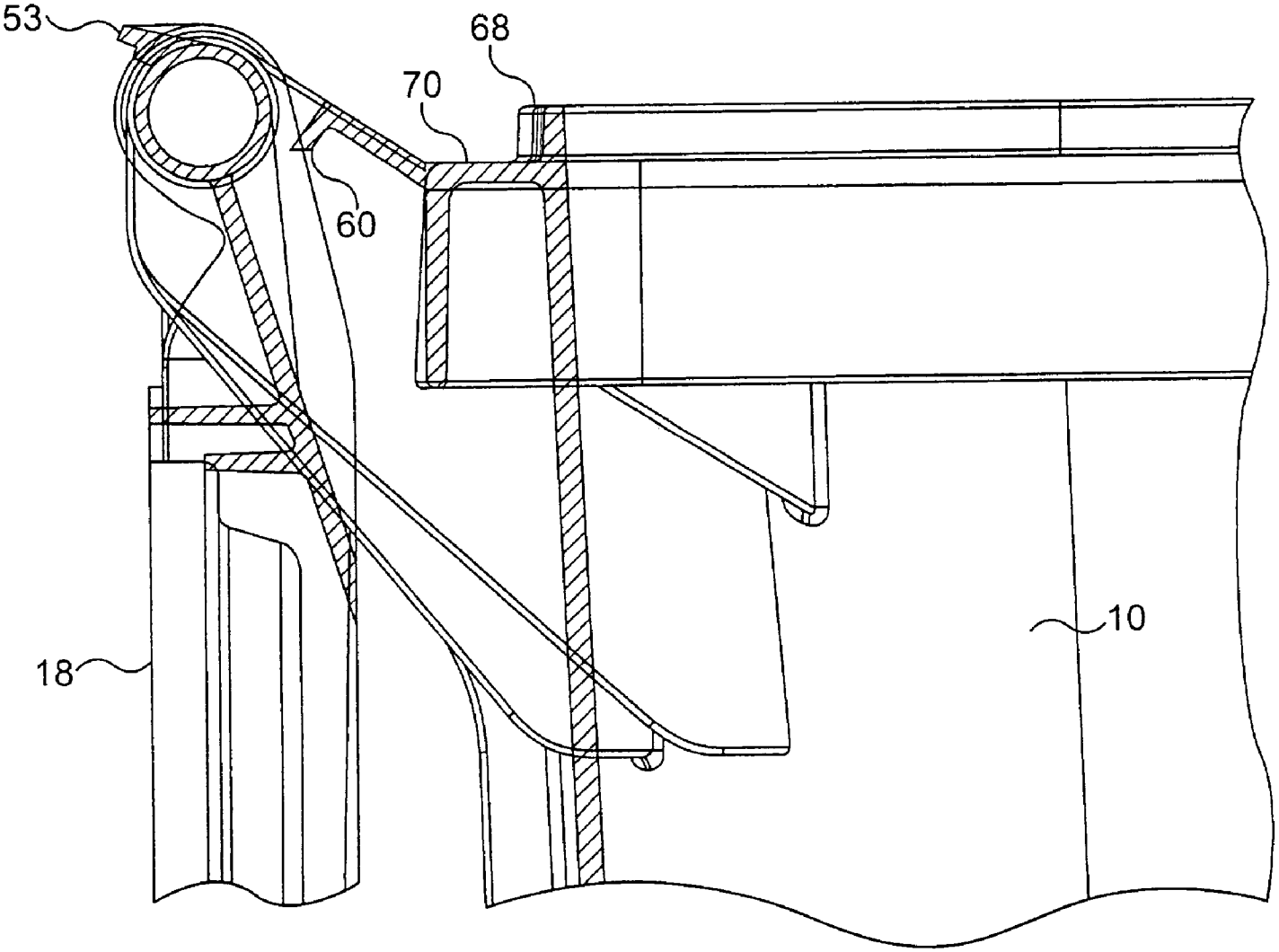
FIG. 10 is an enlarged sectional view of the lid connection portion of the trash can with the lid in the position shown in FIG. 5.
Figure 11:
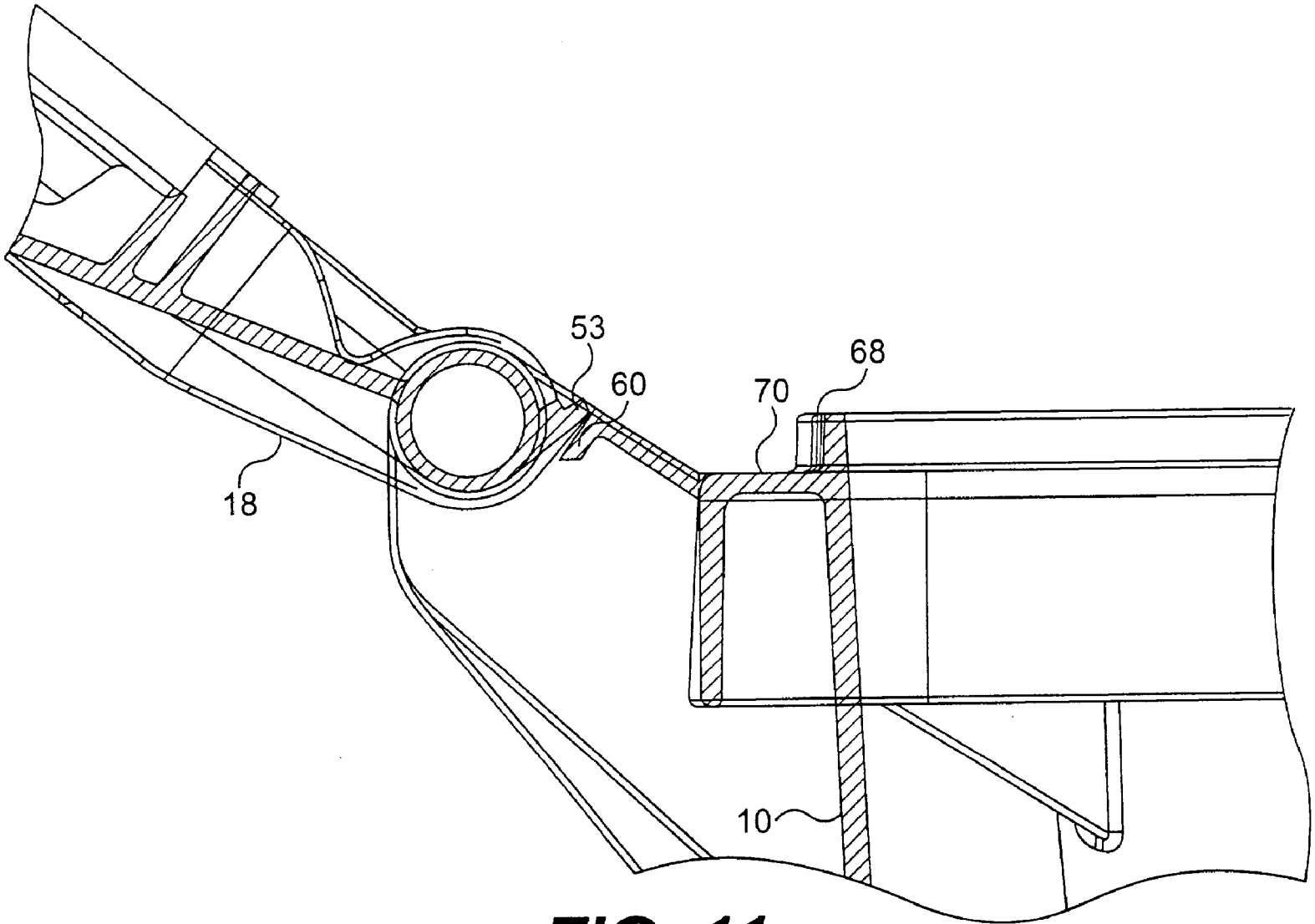
FIG. 11 is an enlarged sectional view of the lid connection portion of the trash can with the lid in the position shown in FIG. 6.
Figure 12:
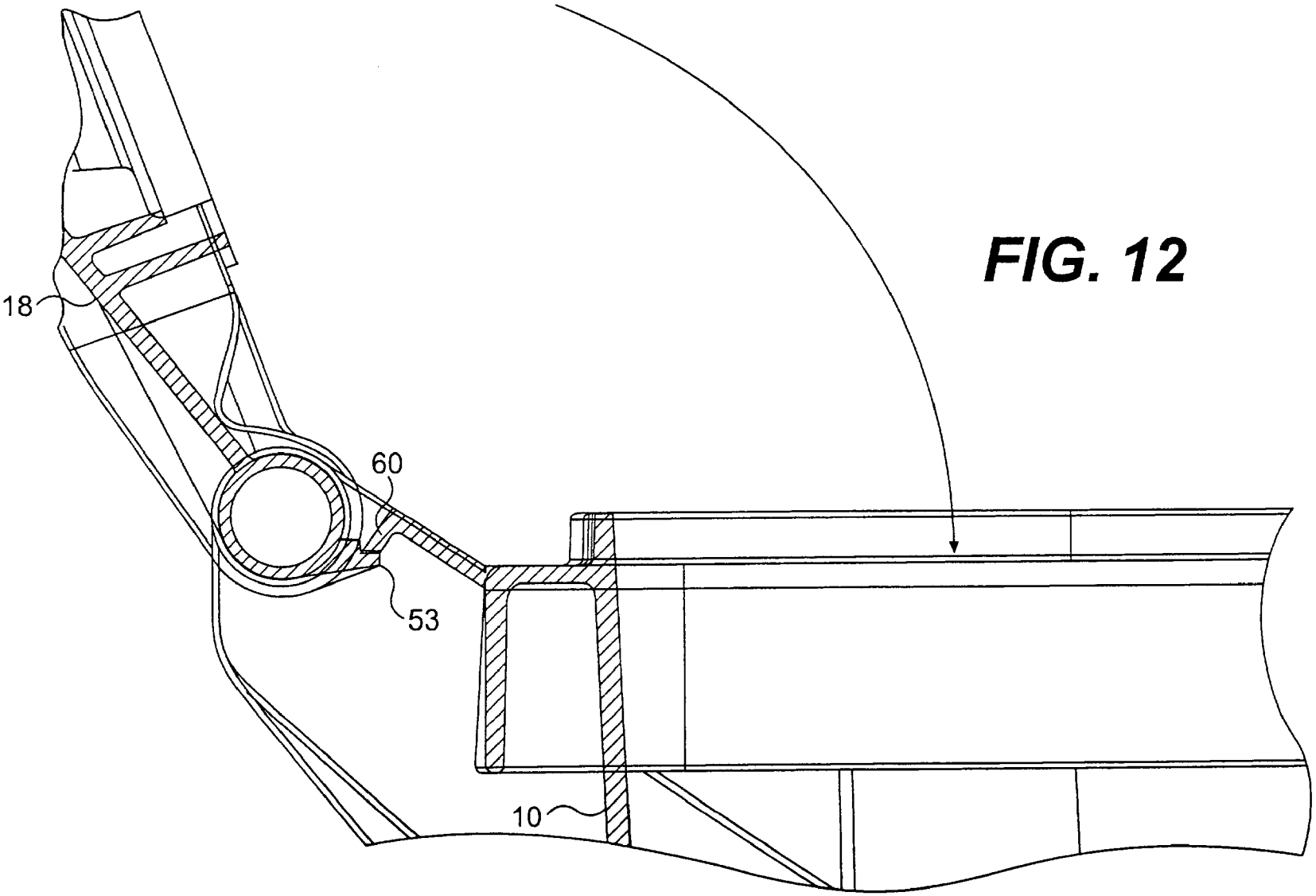
FIG. 12 is a sectional view of the lid connection portion of the can with the lid in the position shown in FIG. 7.

Once a trash can is delivered to the end user and is intended to be placed into operation, the lid is rotated about the hinge from the vertical position shown in FIG. 5 to the position shown in FIG. 6. In accordance with the present invention, once the lid is rotated for the first time past the position shown in FIG. 6, the lid will not rotate back into the initial position, but rather will be stopped and supported in an open position displaced approximately 110° from the fully closed position as shown in FIG. 12 by a rotational hinge stop that includes abutting flange structures. Therefore, the initial position of the hinged lid as shown in FIGS. 5 and 10 is established for the requirement to ship a nested stack of trash cans (with the lids assembled) from one point to the other in the manufacturing and distribution of the trash cans. Then, the trash can lid can be rotated past the flanges of the hinge stop for the first time whereupon the hinge stop is effective to prevent the lid from being returned to the initial position and further effective to support the lid in a convenient open position during the subsequent use of the trash can by the end user.

Figure 8:
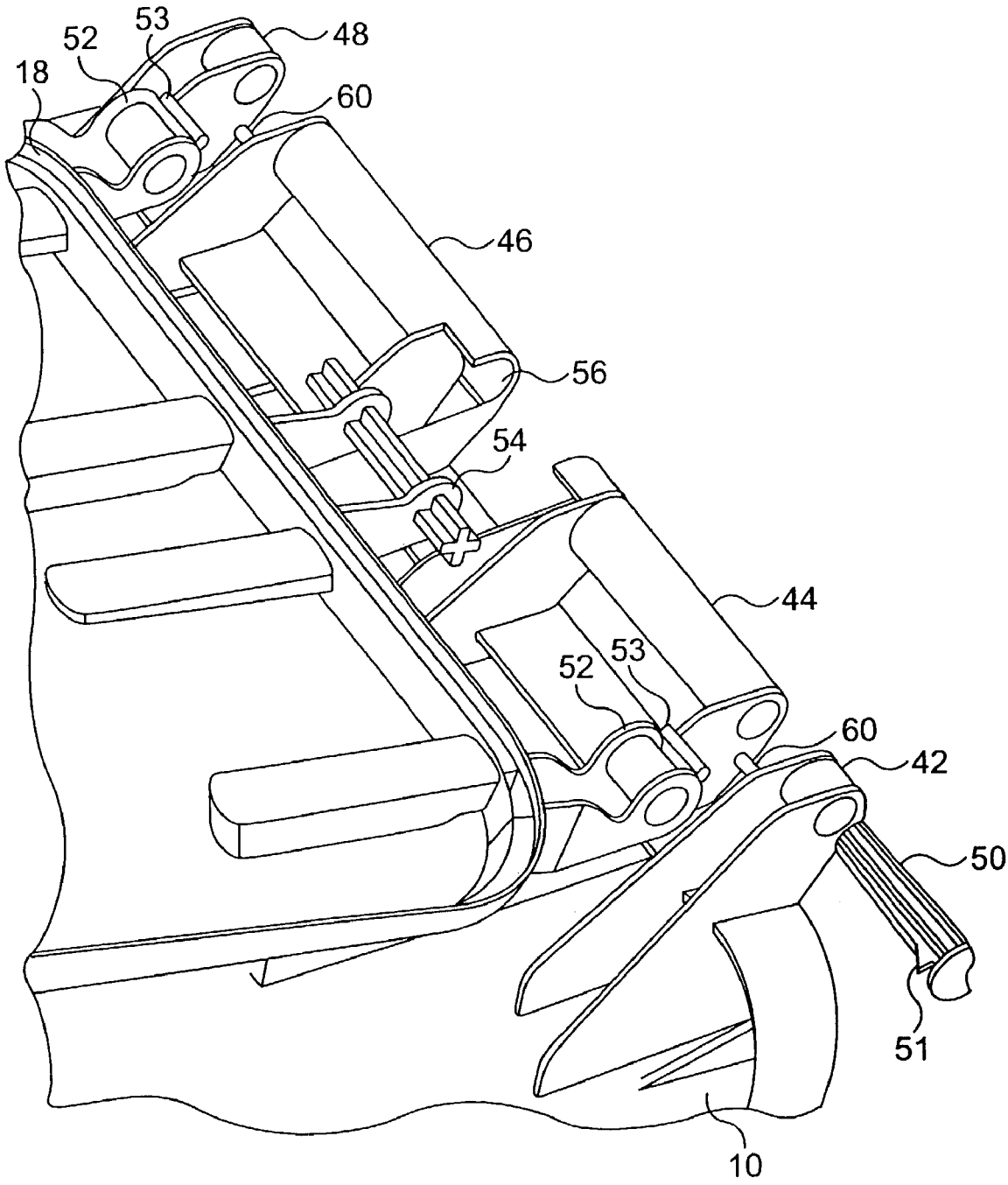
FIG. 8 is an enlarged solid model perspective view showing the lid connection parts that form the hinge, with the lid in a stacking position parallel to the back side of the can but disconnected therefrom.
Figure 9:
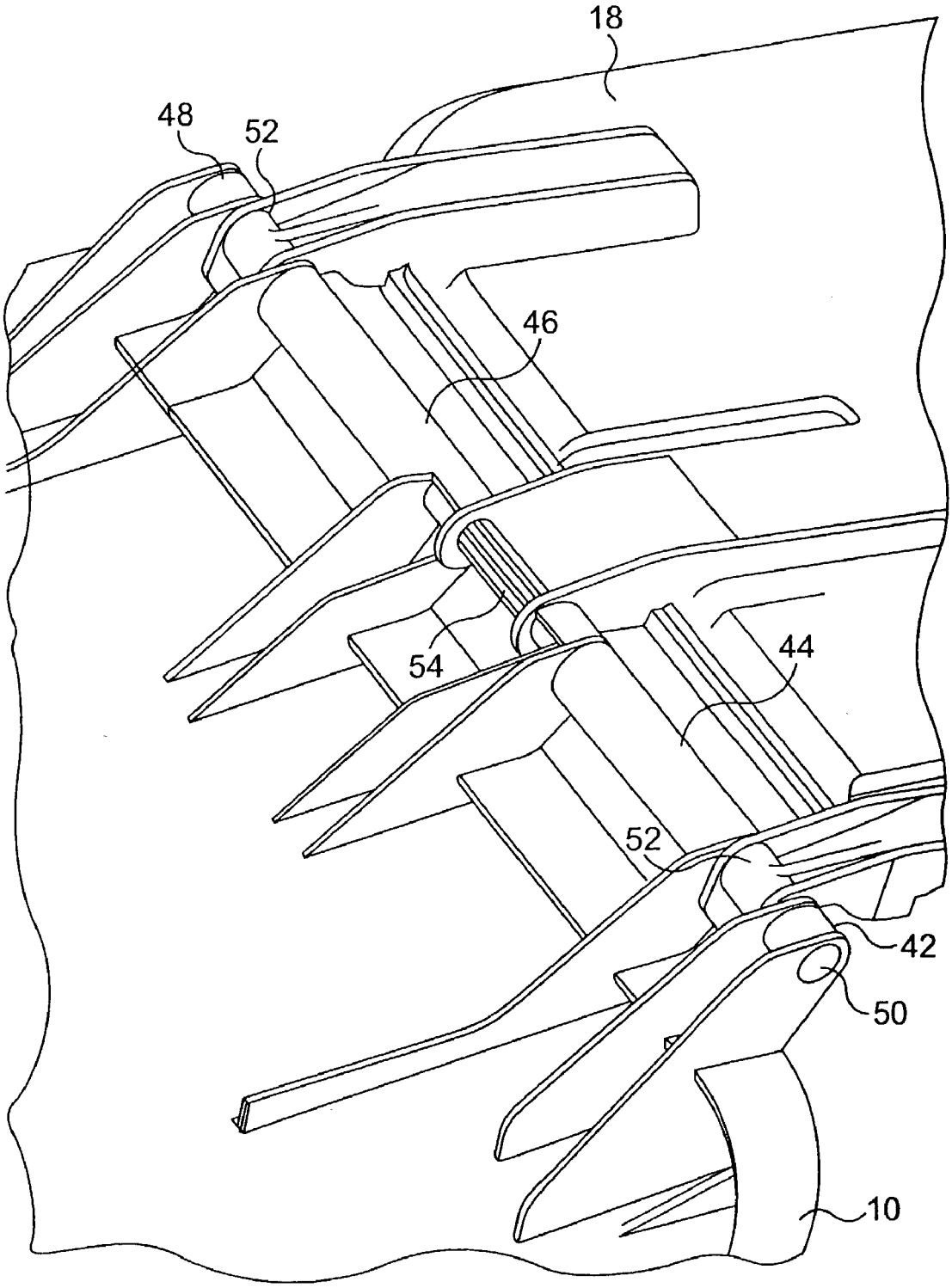
FIG. 9 is an enlarged solid model perspective view showing the lid connected to the back of the can and in a raised vertical position.

FIGS. 8–12 show various cross sectional and solid model views of the hinged structure for the trash can. The hinge structure includes spaced brackets 42, 44, 46 and 48 extending outwardly from the top rear wall of the can and having openings therein to receive connecting pins 50, only one of which is shown in FIG. 8. The back end of the lid 18 is provided with two end hinge supports 52 and a center hinge support 54. As shown in FIG. 9, to attach the lid to the can, the pins 50 are inserted into openings in the brackets 42, 44 and 46, 48 and the hinges 52 on each side of the can and the center hinge support 54 is engaged by curved recesses 56 (FIG. 8) at the inner ends of the brackets 44 and 46. Each pin 50 has a detent 51 adjacent its outer end to lock the pin in place.

Each end hinge support 52 is provided with an extended lip (flange) 53 for interaction with a hinge stop flange 60 on the container. The hinge stop flange 60 is mounted between brackets 42 and 44 and between brackets 46 and 48 as shown in FIG. 8 and extends at an angle substantially tangential to the hinge axis to meet or abut the lip 53 of each end hinge support 52 that rotates with the lid.

As shown in FIG. 10, the lid is in the initial position prior to assembly on the container at which point there is no engagement of the hinge stop flanges 60. As the lid is rotated toward the closed position and reaches a position shown in FIG. 11, the lip 53 of each end hinge support 52 that rotates with the lid is able to slide past the stationary hinge stop flange 60 because the stationary hinge stop flange 60 is sufficiently flexible to allow lip 53 to slide by in the clockwise direction. On the other hand, as shown in FIG. 12, when the lid is rotated in the counterclockwise direction after being moved past the position shown in FIG. 11, the lip 53 of the end hinge support engages the stationary hinge stop flange 60, which has an angled surface that abuts lip 53 for ensuring contact with the lip 53. This prevents the lid from rotating more than about 110° from the fully closed position and ensures support of the lid in the open position, as shown in FIG. 12.

Since the relative displacement and position between each movable lip 53 and a stationary hinge stop flange 60 can be adjusted, the degree of opening of the lid can be adjusted, particularly by lengthening or shortening the hinge stop flange 60 in the direction tangential to the hinge axis. However, the 110° displacement of the lid with respect to the closed position is preferred according to the present invention.

Figure 15:
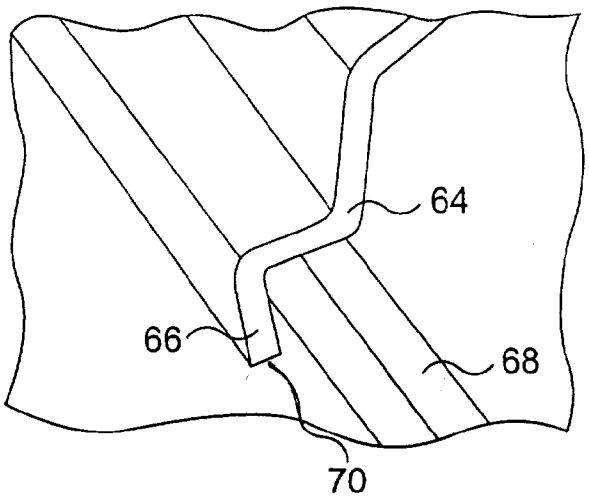
FIG. 15 is an enlarged view of the lid seal structure of the trash can shown in FIG. 13 taken from the area enclosed by dashed lines and labeled FIG. 15.
Figure 13:
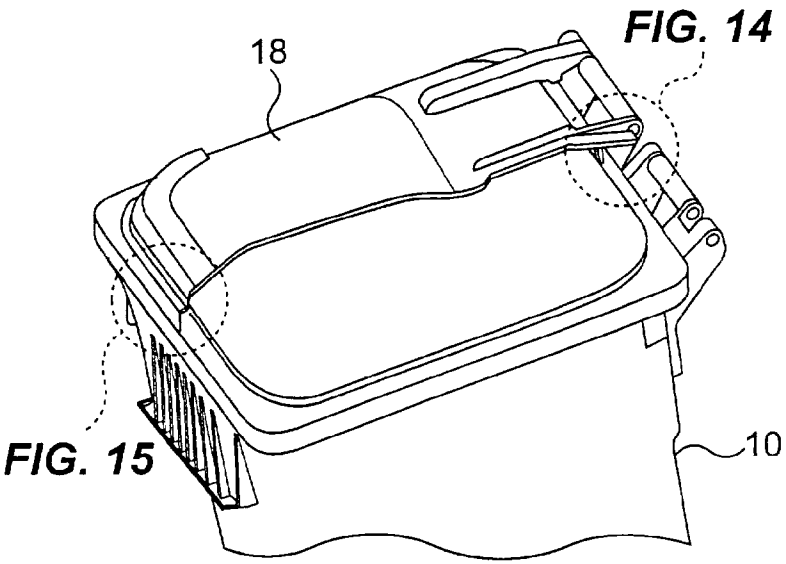
FIG. 13 is a solid model perspective view of an upper portion of the trash can shown in FIG. 1 with the lid partially cut away to illustrate a seal structure of the lid.

As shown in FIG. 13, when the lid is in the fully closed position, which is shown by the solid model figure with the lid partially cut away, a periphery of the lid engages an upstanding rim along the top face of the receptacle of the trash can. In particular, the perimeter of the lid has, as shown in FIG. 15, an inner shoulder flange 64 that engages a top face of an upstanding rim 68 of the receptacle of the trash can, and an additional outer skirt flange 66 that engages the top 70 face of the receptacle to thereby provide two surfaces engaged together about the periphery of the receptacle and the lid for double sealing the trash can when the lid is in the closed position.

Figure 14:
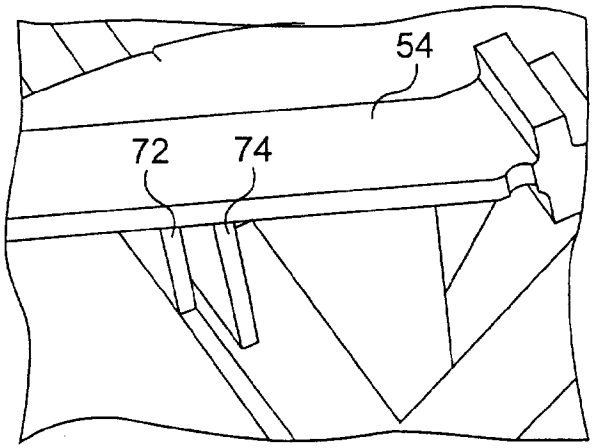
FIG. 14 is an enlarged, solid model view of a portion of the trash can shown in FIG. 13 taken from the area enclosed by dashed lines and labeled FIG. 14 and illustrating the seal structure under a raised area of a hinge support of the lid.
Figure 16:
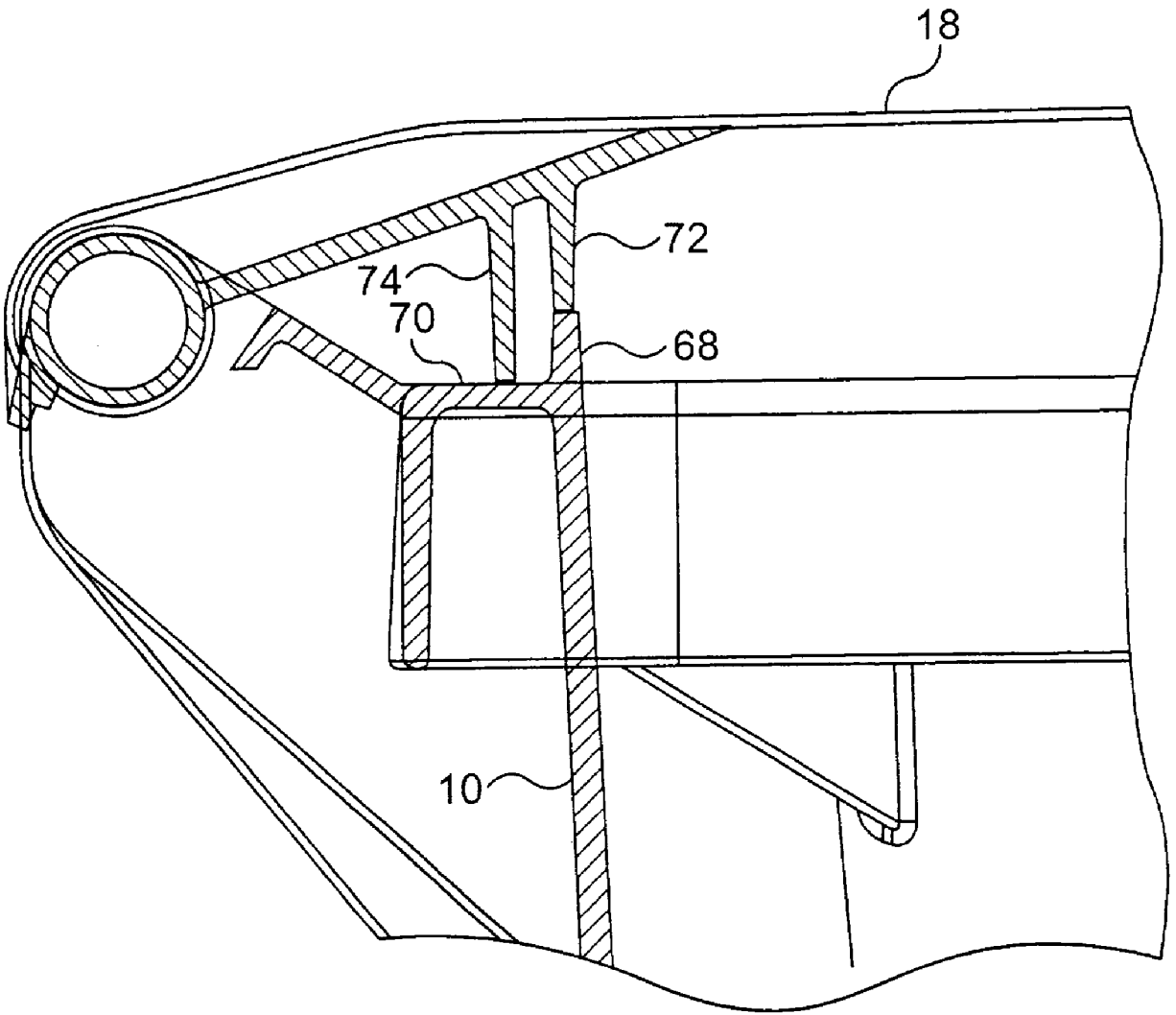
FIG. 16 is a sectional view of the trash can shown in FIG. 1 with the lid in the fully closed position showing the seal of the lid under the raised area of the hinge support to the can along the back side.

Further, FIG. 14 and FIG. 16 show that the center hinge support 54 which extends across the periphery of the receptacle includes an inner depending flange 72 and an outer depending flange 74 that similarly engage the top face of the upstanding rim 68 of the receptacle and the top face 70 of the perimeter of the receptacle, respectively, to maintain the double seal in that area. Further, the end hinge supports 52, as shown in FIGS. 8 and 9, each also have the same double seal structure as that described with respect to center hinge support 54.

I claim:

1. A trash container with a lid, said container comprising:

front, side and back walls and an open top covered by said lid;

a hinge connecting said lid to said container along a top of said back wall so that said lid opens from the front wall;

said container having a latch bar on the front wall to be engaged by a mechanical lifting device when the container is inverted to dump contents of the container;

a recess that opens from a bottom of the front wall of the container having openings on opposite sides of the recess in which the latch bar is mounted such that outer ends of the latch bar extend through the openings into an inside area of the container; and a clearance cut out portion in each side of said recess at a lower end thereof that accommodates with clearance the outer ends of the latch bar of another of said containers which is lower than said container when a plurality of said containers are stacked together in a nested stack, and further including at least one hinge stop flange on said container adjacent said hinge and at least one hinge stop flange on said lid engaging said container hinge stop flange when said lid is rotated from a closed position to an open position, at least one of said hinge stop flange on said container and said hinge stop flange on said lid being flexible, whereby said hinge stop flange on said lid slides past said hinge stop flange on said container when said lid is rotated from an initial assembled position of the lid on the container to the closed position the lid is prevented from rotating back to the initial assembled position by engagement of the outer end of the at least one hinge stop flange of the lid and the outer end of the at least one hinge stop flange of the container.

2. The trash container according to claim 1, wherein said hinge stop flange of said container extends at an angle substantially tangential to an axis of said hinge and has an outer end and said hinge stop flange of said lid has an outer end and wherein said lid is substantially parallel with said back wall in said initial assembled position and after closing the lid for the first time by rotating said lid to the closed position through approximately 270°.

3. The trash container according to claim 2, wherein said lid is held by the engagement of said outer end of said hinge stop flange of the lid and said outer end of said hinge stop flange of the container in an open position that is about 110° in rotation of the lid from the closed position.

4. The trash container according to claim 3, wherein two said hinge stop flanges of the lid and two said hinge stop flanges of the container are provided to support said lid in said open position of about 110°.

5. The trash container according to claim 1, wherein said lid includes a seal about the periphery of the lid that includes first and second flanges, and said container includes an upstanding rim all around said open top and a top face extending outwardly from said rim all around thereof, whereby when said lid is in a closed position said first flange seemingly engages said rim and said second flange seemingly engages said top face to form a double seal around said open top.

* * * * *